US008167480B2

(12) United States Patent
Myhrberg et al.

(10) Patent No.: US 8,167,480 B2
(45) **Date of Patent: *May 1, 2012**

(54) PROCESSING UNIT

(75) Inventors: Lennart Myhrberg, Alvangen (SE); Cristian Eriksson, Molndal (SE)

(73) Assignee: Millipore AB, Nodinge (SE)

( * ) Notice: Subject to any disclaimer, the term of this patent is extended or adjusted under 35 U.S.C. 154(b) by 0 days.

This patent is subject to a terminal disclaimer.

(21) Appl. No.: 12/822,075

(22) Filed: Jun. 23, 2010

(65) Prior Publication Data

US 2010/0290311 A1 Nov. 18, 2010

Related U.S. Application Data

(63) Continuation of application No. 10/568,446, filed on Sep. 15, 2006, now Pat. No. 7,815,362.

(30) Foreign Application Priority Data

Mar. 1, 2004 (SE) ..... 0400517-9

(51) Int. Cl.
*B01F 13/08* (2006.01)
*B01F 7/02* (2006.01)

(52) U.S. Cl. ..... 366/273; 366/304; 366/305

(58) Field of Classification Search ..... 366/273, 366/274, 304, 305, 303; 416/3; 417/420
See application file for complete search history.

(56) References Cited

U.S. PATENT DOCUMENTS 2,606,502 A 8/1952 Carlson
3,912,236 A * 10/1975 Zipperer et al. ..... 366/302
4,209,259 A 6/1980 Rains et al.
5,141,327 A 8/1992 Shiobara
5,205,647 A 4/1993 Ricciardi
(Continued)

FOREIGN PATENT DOCUMENTS

DE 3912190 A1 11/1989
(Continued)

OTHER PUBLICATIONS

Database WPI, Week 198737, Derwent Publications, Ltd., London, GB; AN 1987-262994 & SU 1287930 A, (TULA Poly), Feb. 7, 1987, Abstract.

*Primary Examiner* — Tony G Soohoo
(74) *Attorney, Agent, or Firm* — Dickstein Shapiro LLP

(57) ABSTRACT

A device for cutting/shearing in a process vessel (1) product clusters and/or materials (3) into smaller particles and dispersing them in a liquid product bulk (4) or for mixing in the process vessel liquid products with each other that are difficult to mix. The device has an electric motor (13) arranged out-side the process vessel and, driven by the same by magneto drive, a processing unit (12) positioned inside the process vessel. The processing unit comprises a stationary inner part (14) and, rotatable about this, an outer part (15), the inner and outer parts having the shape of substantially concentric rings (16, 17) arranged with a close fit to each other and having a plurality of through slotshaped shearing recesses (18) opposing each other. The products that are to be cut/shorn and/or mixed are suppliable to the area of the common center axis (20) of the rings and are thrown out through the shearing recesses while being shorn into pieces in order to leave the processing unit through the ring of the outer part, which ring also contributes to rotating the products in the process vessel around the processing unit.

11 Claims, 3 Drawing Sheets

U.S. PATENT DOCUMENTS

| | | | | |
|---|---|---|---|---|
| 5,364,184 | A | 11/1994 | Rains | |
| 6,019,499 | A | 2/2000 | Selivanov | |
| 6,241,472 | B1 | 6/2001 | Bosch et al. | |
| 6,386,751 | B1 | 5/2002 | Wootan et al. | |
| 6,568,844 | B1 | 5/2003 | Arthun et al. | |
| 7,815,362 | B2 * | 10/2010 | Myhrberg et al. | 366/273 |

FOREIGN PATENT DOCUMENTS

| | | | |
|---|---|---|---|
| JP | 42-13990 | | 8/1967 |
| JP | 62-43631 | A | 2/1987 |
| JP | 63-302964 | A | 12/1988 |
| JP | 7-790 | A | 1/1995 |
| JP | 2002-509018 | A | 3/2002 |
| SU | 371960 | | 3/1973 |
| SU | 1219125 | A | 3/1986 |
| SU | 1287930 | A | 2/1987 |
| SU | 1378905 | | 3/1988 |
| WO | WO-99/36163 | | 7/1999 |
| WO | WO-99/36163 | A1 | 7/1999 |

* cited by examiner

PROCESSING UNIT

This application is a continuation of and claims priority to U.S. application Ser. No. 10/568,446, filed Sep. 15, 2006 now U.S. Pat. No. 7,815,362, the entire disclosure of which is hereby incorporated by reference.

TECHNICAL FIELD

This invention relates to a unit or device for processing products in a process vessel, especially for cutting/shearing product clusters and/or materials into smaller particles and dispersing them in a more or less liquid product bulk or for mixing therein more or less liquid products with each other which are difficult to mix, said device having a drive unit positioned outside the process vessel and a processing unit driven by the drive unit and positioned inside the process vessel.

BACKGROUND ART

In the liquid processing industry, such as the food, beverage, pharmaceutical and biotechnology industry, processing devices such as emulsifiers, homogenisers and mixers have been used for many years in certain steps of the production process. They are often intended for shearing of the products. The purpose of such shearing is above all to shear product clusters and/or materials into smaller particles and disperse them in a more or less liquid product bulk. The purpose can also be to mix more or less liquid products with each other that are difficult to mix, for instance oil-based liquid with water-based liquid.

A common feature of processing devices of the above type is that their processing unit is positioned and operates inside the process vessel whereas the drive for driving it is positioned outside the vessel. The driving force is transmitted by a drive shaft usually made of metal, which extends through the wall of the vessel, either from the top or from the bottom thereof. In both cases, the drive shaft must be sealed with rotary seals to prevent leakage between the surroundings of the vessel and the enclosure formed by the vessel.

There is a constant and well-known problem with this type of rotary seals in the sense that they are constantly exposed to wear, which results in particle generation, and without previous warning start to leak during the process. In most cases this leakage results in microbial and/or particulate contamination of the products that are being processed and, thus, causes in most cases a total loss of the entire product batch.

A further problem of prior-art processing devices is that they have hidden cavities in the stuffing boxes and have long drive shaft supports, which practically cannot be cleaned in situ. In many applications, especially in the pharmaceutical and biotechnology industry, this problem can be disastrous if it is not taken care of. The problem may cause cross-contamination of various infected products between the batches. In most cases this results in loss of the batch.

SUMMARY OF THE INVENTION

The main object of the invention is to provide a processing device of the type stated by way of introduction, which has no direct mechanical drive force transmission between the exteriorly positioned drive unit and the interiorly positioned processing unit, and whose processing unit by appropriate construction and design of its components effectively and with great capacity shears the products to be processed into pieces.

Another object of the invention is to provide a processing device as described above, in which all parts inside the process vessel which come into contact with the products are designed to minimise the risk of contamination and depositions and are easy to clean in situ.

Yet another object of the invention is to provide a processing device, the components of which are of high quality with a long life but are easy to reach for replacement if needed.

According to the invention, these and other related objects are achieved by a processing device of the type stated by way of introduction, which is characterised in that the drive unit drives the processing unit without a shaft, and that the processing unit comprises a stationary inner part and, rotatable about this, an outer part, the inner and outer parts having the shape of substantially concentric rings arranged with a close fit to each other and having a plurality of through shearing recesses opposing each other, and the products that are to be cut and/or mixed being suppliable to the area of the common centre axis of the rings and being induced to move out through the shearing recesses while being shorn into pieces and leave the processing unit through the ring of the outer part, said ring also contributing to rotating the products in the process vessel around the processing unit.

In a preferred embodiment of the invention, the shearing recesses comprise circular, oval or otherwise shaped holes or elongate slots through the associated ring.

The slots are preferably substantially parallel to and/or inclined to the centre axis of the associated ring and extend along substantially the entire height of the associated ring. By inclining at least the slots in the ring of the outer part towards the centre axis of this ring, the shear effect can be further increased while at the same time a downward component force on the ring can be provided.

In a preferred further development, the ring of the outer part has a free end with a collar over the corresponding free end of the ring of the inner part and the shearing recesses in the ring of the outer part extend preferably through the collar, thereby further improving the transport and shear effect.

To make the entire processing unit more compact and more effective, the ring of the inner part can advantageously constitute a part of a stator with a bearing, and the ring of the outer part can in the same advantageous way constitute a part of a rotor, which is rotatably mounted on the bearing of the stator.

In a preferred further development, the rotor, and the associated ring can be completely rotationally symmetrical and lack projecting components such as wings, drivers etc, whereby the rotor is rotatable at a high speed.

Finally, it is most preferred for the drive unit's driving, without a shaft, of the processing unit if this driving occurs by magneto drive.

BRIEF DESCRIPTION OF THE DRAWINGS

A currently especially preferred embodiment of the invention will now be described in more detail with reference to the accompanying drawings, in which.

DESCRIPTION OF A PREFERRED EMBODIMENT

Figure 1:
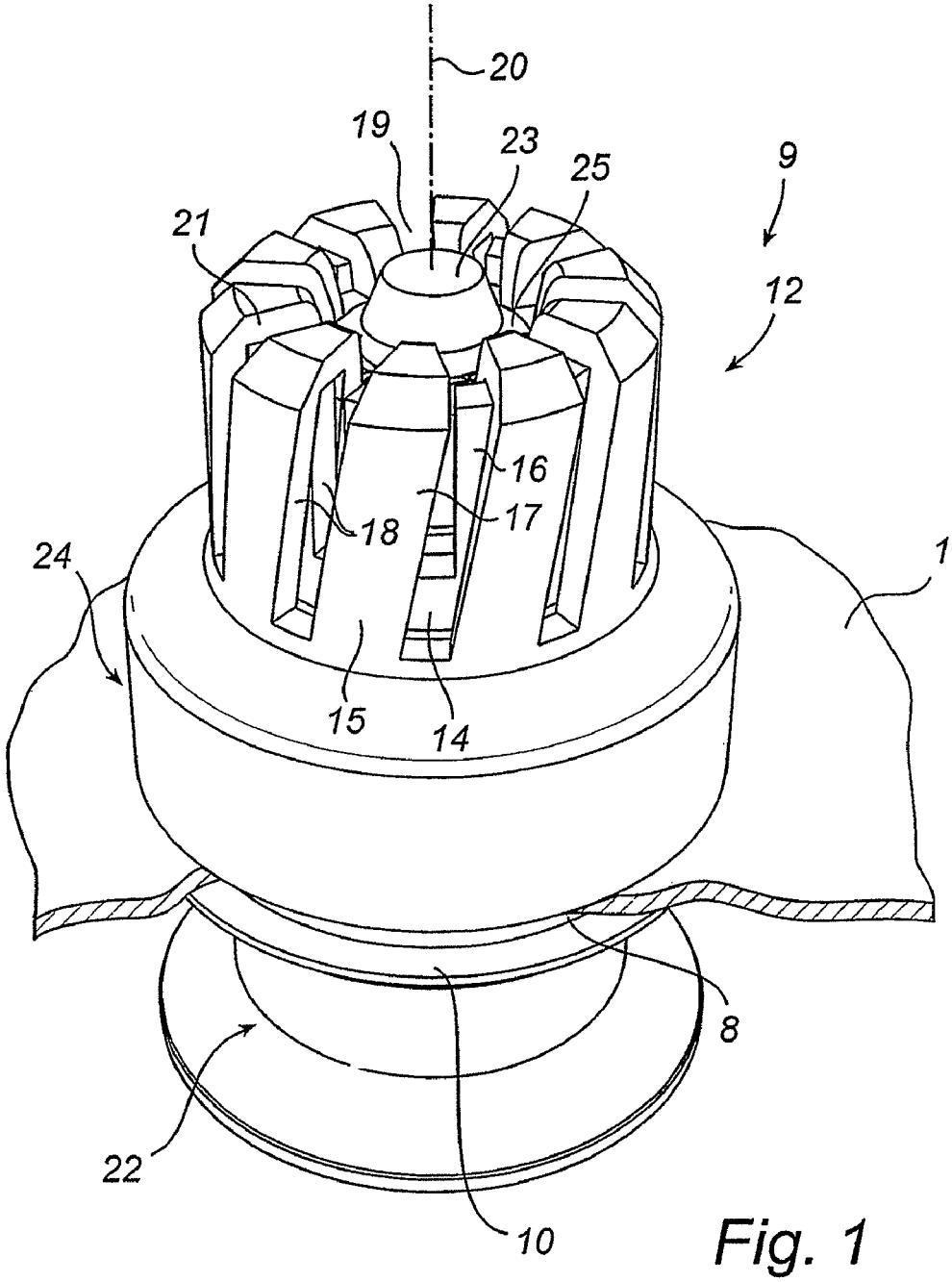
FIG. 1 is a perspective view, obliquely from above and with some components removed, of a particularly preferred embodiment of a processing device according to the invention.
Figure 2:
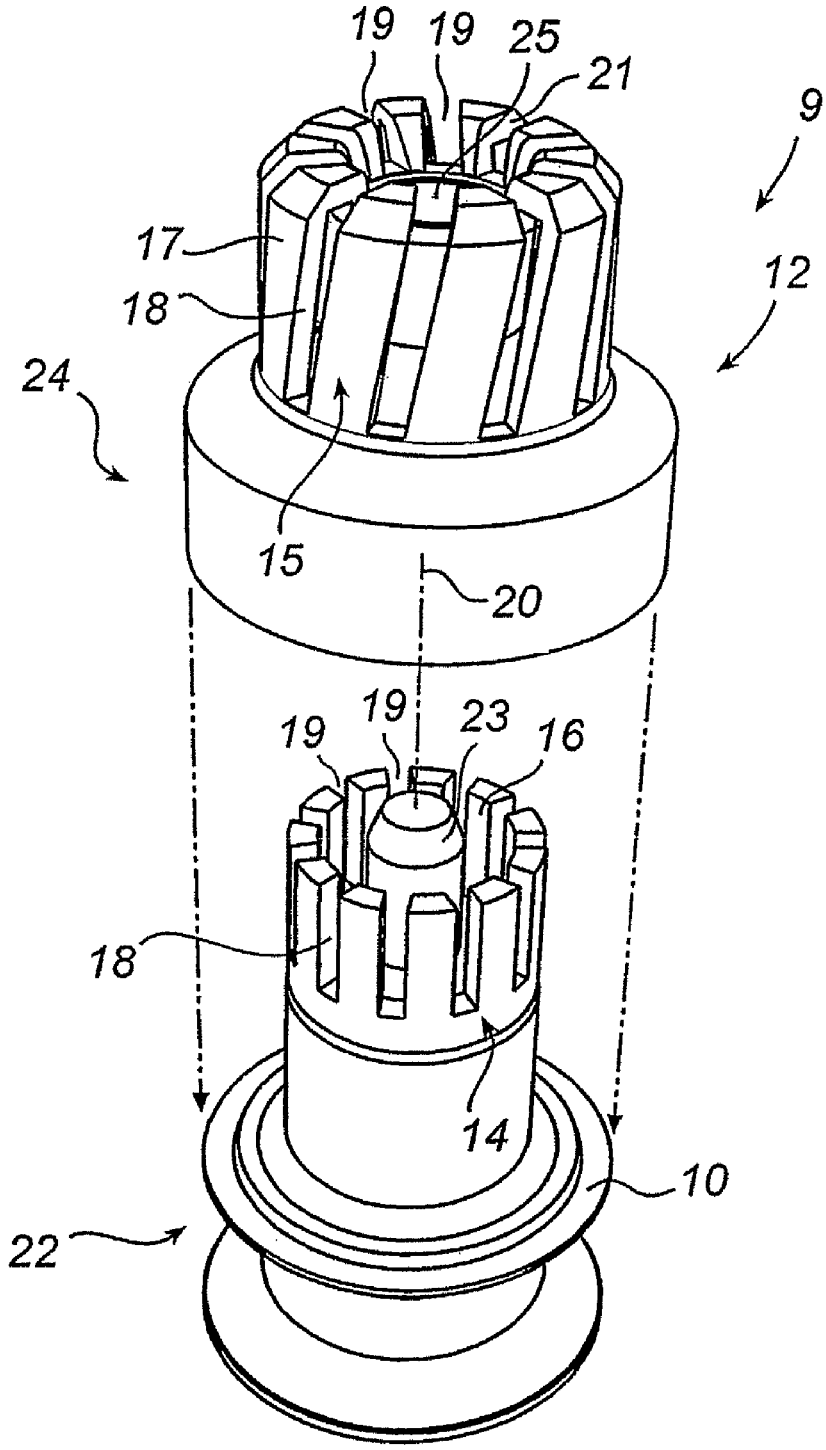
FIG. 2 is a view, corresponding to FIG. 1, of the processing device with main components of a processing unit included therein and spaced apart to be seen more clearly.
Figure 3:
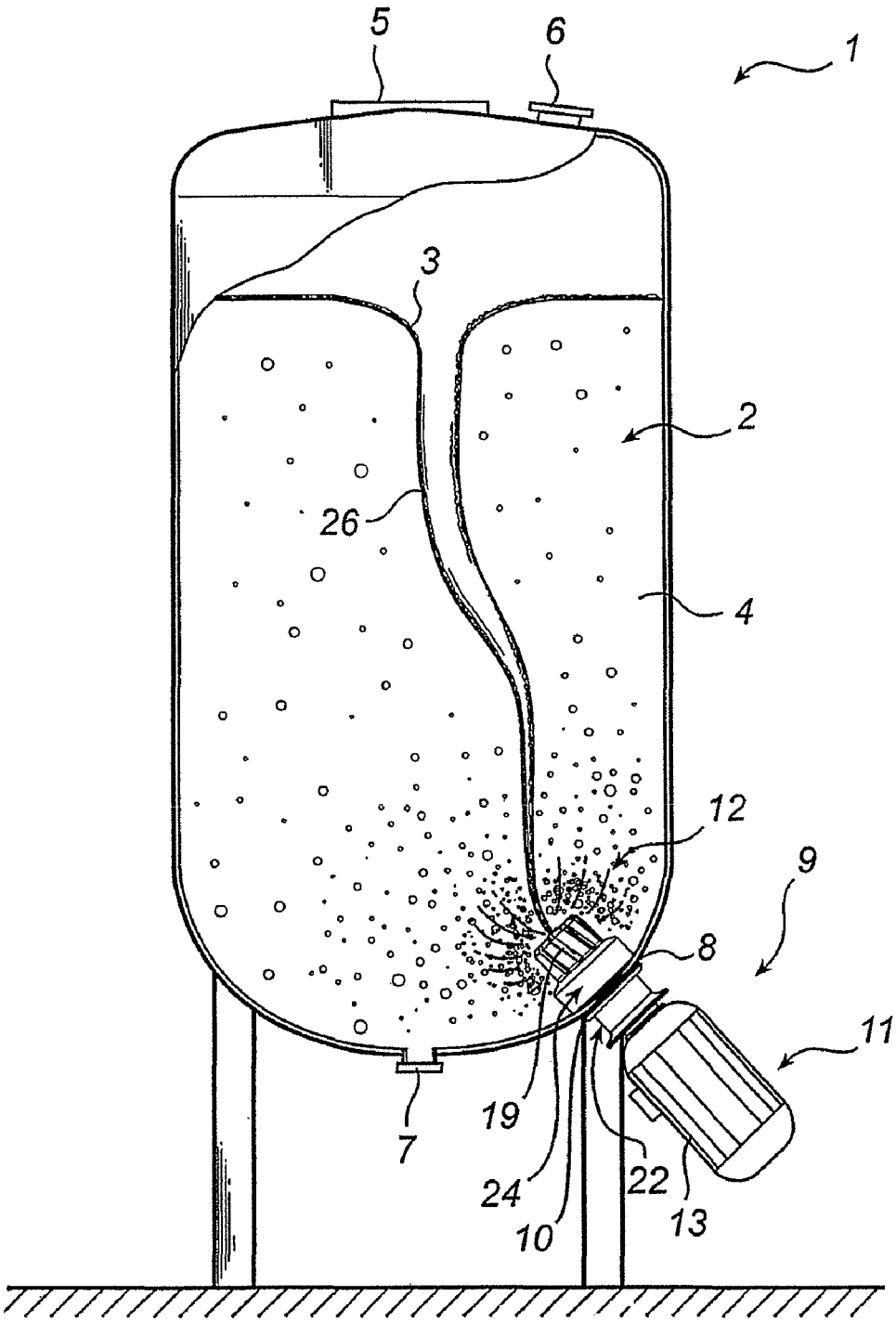
FIG. 3 is a schematic side view of a cut process vessel with the processing device according to FIGS. 1 and 2 mounted at the bottom of the vessel.

FIG. 3 illustrates a process vessel generally designated 1 and intended for processing products 2, in the case shown preferably by shearing products 3 for example in the form of clusters and/or materials into smaller particles and dispersing them in a more or less liquid product bulk 4. Alternatively, it is possible to mix, in a manner not shown in detail, in the process vessel 1 more or less liquid products which are difficult to mix. Of course, further applications are conceivable within the scope of the inventive concept.

The process vessel 1 suitably consists of a closed tank of sheet metal or some other metal or plastic, preferably stainless steel or the like. The process vessel 1 is usually positioned vertically and has at its top a manhole cover 5 for access to the interior of the process vessel for, for example, exchange and cleaning of interior components (see below) etc. The process vessel 1 has also at its top an inlet 6 for supplying the product or products 3 which are to be cut by shearing and dispersed in the product bulk 4 or mixed with the same, and at the bottom an outlet 7 for the completely processed products.

At the bottom of the process vessel 1 there is at a distance from the outlet 7 a substantially circular hole 8 for mounting of a processing device according to the invention which will be described in more detail below and which is generally designated 9. A flange 10 belonging to the processing device 9 is arranged in the hole 8 and is sealed in a contamination-safe manner, suitably by welding, against the edge of the hole 8.

The processing device 9 is basically made up of two main components, viz. a drive unit 11 positioned outside the process vessel 1 and a processing unit 12 driven by the drive unit and positioned inside the process vessel.

The drive unit 11 preferably has the form of an electric motor 13, whose non-visible drive shaft extends from the outside of the process vessel 1 and into the processing unit 12 on the inside of the process vessel, in which processing unit the drive shaft is freely rotatable to drive the processing unit in a manner that will be described below.

In the embodiment illustrated and described, the processing unit 12 suitably comprises a stationary, inner part 14 and, rotatable about the same, an outer part 15. The inner and outer parts 14, 15 are preferably made of metal, suitably stainless steel, or some other material suitable for the purpose. The inner and outer parts 14, 15 here have the shape of substantially concentric inner and outer rings 16 and 17, which are closely fitted to each other. Each ring 16, 17 has a plurality of through shearing recesses 18, the through shearing recesses in the inner ring 16 being directed outwards to the through shearing recesses 18 in the outer ring 17 so as to form shearing pairs.

The shearing recesses 18 of the two rings 16, 17 may comprise circular, oval or otherwise formed holes or, like in the case shown, comprise elongate slots 19 through the associated ring.

These slots 19 of the respective rings 16, 17 are substantially straight and parallel to each other, the slots of the inner ring 16 being substantially parallel to the centre axis 20 of the inner ring, while the slots 19 of the outer ring 17 are slightly inclined, say about 15°, to the centre axis of the outer ring 17, which coincides with the centre axis 20. In both cases, the slots 19 extend along substantially the entire height of the associated ring 16, 17.

In the preferred and shown embodiment, the ring 17 of the outer part 15 has an upwardly directed free end with an inwardly directed collar 21 over the corresponding free end of the ring 16 of the inner part 14. The shearing recesses 18 in the ring 17 of the outer part 15 conveniently extend through the collar 21.

In the especially preferred embodiment, the ring 16 of the inner part 14 consists of a part of a stator 22 which is included in the processing unit 12 and which has an upwardly directed pivot 23 and which is attached in the manner described above via the flange 10 to the edge of the hole 8 and, thus, is stationary. In the same preferred way, the ring 17 of the outer part 15 constitutes a part of a rotor 24 which is included in the processing unit 12 and which is freely rotatably mounted on the pivot 23 of the stator 22 by a slide bearing 25.

As mentioned above, the drive shaft of the electric motor 13 is freely rotatable in the processing unit 12. More specifically, the drive shaft is freely rotatably received in a recess (not shown) in the stator 22 and supports, directly or indirectly, at its outer free end a plurality of drive magnets (not shown). These drive magnets drive on rotation of the drive shaft by the electric motor 13 associated driven magnets (not shown) mounted inside the rotor 24 by connected magneto drive, so that the rotor 24 without direct mechanical drive force transmission, i.e. without shaft, is rotated at the same speed as the drive shaft.

The drive unit 11 does not have to be an electric motor 13 but may instead be a compressed air motor or a hydraulic motor. Moreover, there may be arranged between an optional type of motor and its drive shaft with the drive magnets a gearbox (not shown) for the desired gear ratio of the motor in question to the rotor 24.

By the rotor 24 preferably being completely rotationally symmetrical and completely without projecting components such as wings, drivers etc, it may then be rotated at a high speed.

At a suitably high speed of the rotor 24, there can be created, in combination with parameters such as the shape of the process vessel 1, the product volume thereof, the viscosity etc, a vortex 26 in the product bulk 4 from its free surface in the process vessel 1 to the processing unit 12. When needed, this vortex can be used to accelerate the transport of the products 3 that are to be cut into pieces by shearing and/or mixed, to the processing unit 12.

To further increase the shearing and/or mixing effect of the processing unit 12, one or more additional stators and rotors are arranged alternately outside one another in another preferred embodiment of the invention, which is not shown, i.e. at least one additional stator similar to the stator 22 is stationarily, concentrically arranged around the rotor 24 and at least one additional rotor similar to the rotor 24 is rotatably, concentrically arranged around the additional stator etc.

The invention should not be considered limited to the shown and described preferred embodiment and its variants but can be modified in various ways within the scope of the appended claims.

The invention claimed is:

1. A device for processing products (2) in a process vessel (1), especially for cutting/shearing product clusters and/or materials (3) into smaller particles and dispersing them in a more or less liquid product bulk (4) or for mixing therein more or less liquid products with each other which are difficult to mix, said device having a drive unit (11) positioned outside the process vessel (1) and a processing unit (12) driven by the drive unit and positioned inside the process vessel, characterised in that the drive unit (11) drives the processing unit (12) without a shaft, and that the processing unit (12) comprises a stationary inner part (14) and, rotatable about this, an outer part (15), the inner and outer parts being rotationally symmetrical, consisting of substantially concentric rings (16, 17) arranged with a close fit to each other and having a plurality of through shearing recesses (18) opposing each other, and lacking projecting components other than the substantially concentric rings, and the products (2, 3, 4) that are to be cut/shorn and/or mixed being suppliable to the area of the common centre axis (20) of the rings (16, 17) and being induced to move out through the shearing recesses while being shorn into pieces and leave the processing unit (12) through the ring (17) of the outer part (15), said ring also contributing to rotating the products (2, 3, 4) in the process vessel (1) around the processing unit (12).

2. A device as claimed in claim 1, in which the shearing recesses (18) comprise circular, oval or otherwise shaped holes or elongate slots (19) through the associated ring (16, 17).

3. A device as claimed in claim 2, in which the slots (19) are substantially parallel to and/or inclined to the centre axis (20) of the associated ring (16, 17) and extend along substantially the entire height of the associated ring.

4. A device as claimed in claim 1, in which the drive unit (11) drives the rotor (24) of the processing unit (12) by magneto drive without a shaft.

5. A device for processing products (2) in a process vessel (1), especially for cutting/shearing product clusters and/or materials (3) into smaller particles and dispersing them in a more or less liquid product bulk (4) or for mixing therein more or less liquid products with each other which are difficult to mix, said device having a drive unit (11) positioned outside the process vessel (1) and a processing unit (12) driven by the drive unit and positioned inside the process vessel, characterised in that the drive unit (11) drives the processing unit (12) without a shaft, and that the processing unit (12) comprises a stationary inner part (14) and, rotatable about this, an outer part (15), the inner and outer parts having the shape of substantially concentric rings (16, 17) arranged with a close fit to each other and having a plurality of through shearing recesses (18) opposing each other, wherein the outer part (15) is the furthest part from an axis of rotation of the outer part (15) in a direction perpendicular to the axis of rotation, and the products (2, 3, 4) that are to be cut/shorn and/or mixed being suppliable to the area of the common centre axis (20) of the rings (16, 17) and being induced to move out through the shearing recesses while being shorn into pieces and leave the processing unit (12) through the ring (17) of the outer part (15), said ring also contributing to rotating the products (2, 3, 4) in the process vessel (1) around the processing unit (12).

6. A device as claimed in claim 5, in which the shearing recesses (18) comprise circular, oval or otherwise shaped holes or elongate slots (19) through the associated ring (16, 17).

7. A device as claimed in claim 6, in which the slots (19) are substantially parallel to and/or inclined to the centre axis (20) of the associated ring (16, 17) and extend along substantially the entire height of the associated ring.

8. A device as claimed in claim 5, in which the drive unit (11) drives the rotor (24) of the processing unit (12) by magneto drive without a shaft.

9. A device as claimed in claim 5, wherein the shearing recesses (18) comprise elongate slots (19) through the associated ring (16, 17), and wherein the slots (19) of the ring (17) of the outer part (15) are inclined to the center axis (20) of the ring (17) of the outer part (15).

10. A device as claimed in claim 9, wherein the slots (19) of the ring (16) of the inner part (14) are substantially parallel to the center axis (20) of the ring (16) of the inner part (14).

11. A device as claimed in claim 5, wherein the inner part (14) and the outer part (15) are rotationally symmetrical.

* * * * *